US007014127B2

(12) United States Patent
Valpey, III et al.

(10) Patent No.: US 7,014,127 B2
(45) **Date of Patent: *Mar. 21, 2006**

(54) AEROSOL DISPENSER ASSEMBLY HAVING LOW VOLATILE ORGANIC COMPOUND (VOC) CONTENT

(75) Inventors: Richard S. Valpey, III, Lindenhurst, IL (US); Paul A. Clark, Racine, WI (US); Kevin J. Moe, Racine, WI (US); Robert E. Kendrick, Oak Creek, WI (US); Leon C. Samuelson, Racine, WI (US); Cary E. Manderfield, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 154 days.

This patent is subject to a terminal disclaimer.

(21) Appl. No.: 10/653,211

(22) Filed: Sep. 3, 2003

(65) Prior Publication Data

US 2004/0144864 A1 Jul. 29, 2004

Related U.S. Application Data

(63) Continuation-in-part of application No. 10/350,011, filed on Jan. 24, 2003, now Pat. No. 6,824,079.

(51) Int. Cl.
*B05B 7/32* (2006.01)
*B65D 83/00* (2006.01)

(52) U.S. Cl. ..... 239/337; 239/343; 239/354; 222/402.1

(58) Field of Classification Search ..... 239/340, 239/343, 354, 461, 518, 337; 222/402.1, 222/402.13, 402.15, 402.23
See application file for complete search history.

(56) References Cited

U.S. PATENT DOCUMENTS

| | | | | |
|---|---|---|---|---|
| 3,018,023 A | | 1/1962 | Talarico | 222/394 |
| 3,137,416 A | | 6/1964 | Shepherd et al. | 222/394 |
| 3,544,258 A | | 12/1970 | Presant et al. | 222/192 |
| 3,583,642 A | * | 6/1971 | Crowell et al. | 239/337 |
| 3,630,415 A | * | 12/1971 | Morane et al. | 222/129 |
| 3,635,261 A | * | 1/1972 | Morane et al. | 141/3 |
| 3,647,119 A | | 3/1972 | Samuelson | 222/402.18 |
| 3,648,932 A | * | 3/1972 | Ewald et al. | 239/337 |
| 3,715,081 A | * | 2/1973 | Green | 239/573 |
| 4,019,657 A | | 4/1977 | Spitzer et al. | 222/136 |
| 4,056,500 A | | 11/1977 | Stern | 260/29.6 |

(Continued)

FOREIGN PATENT DOCUMENTS

EP 0420538 A1 4/1991

(Continued)

OTHER PUBLICATIONS

Patent Abstracts of Japan, vol. 015, No. 388 (C-0872), Oct. 2, 1991.

(Continued)

*Primary Examiner*—David A. Scherbel
*Assistant Examiner*—Seth Barney

(57) ABSTRACT

An aerosol dispenser assembly (1) has a container (2) holding a liquid product and a liquefied gas propellant for propelling the liquid product from the container, the propellant being present in a quantity of at most about 25% by weight of the contents of the container (2). A valve (4) is attached to the container (2) for selectively dispensing the liquid product from the container (2) as a mist. The assembly (1) is configured such that the mist has a small particle size, is dispensed at an expeditious rate, and very little product is retained in the container (2) when the propellant is depleted.

80 Claims, 4 Drawing Sheets

U.S. PATENT DOCUMENTS

| | | | | | |
|---|---|---|---|---|---|
| 4,116,370 | A | | 9/1978 | Spitzer et al. | 222/402.18 |
| 4,117,958 | A | | 10/1978 | Spitzer et al. | 222/402.18 |
| 4,124,149 | A | | 11/1978 | Spitzer et al. | 222/402.19 |
| 4,141,472 | A | | 2/1979 | Spitzer et al. | 222/189 |
| 4,152,416 | A | | 5/1979 | Spitzer et al. | 424/46 |
| 4,174,386 | A | | 11/1979 | Spitzer et al. | 424/47 |
| 4,203,552 | A | * | 5/1980 | Hayes | 239/337 |
| 4,230,243 | A | | 10/1980 | Spitzer et al. | 222/402.18 |
| 4,322,037 | A | | 3/1982 | Heeb et al. | 239/337 |
| 4,431,120 | A | | 2/1984 | Burger | 222/192 |
| 4,511,069 | A | * | 4/1985 | Kalat | 222/263 |
| 4,534,958 | A | | 8/1985 | Adams et al. | 424/45 |
| 4,680,173 | A | | 7/1987 | Burger | 424/47 |
| 4,935,224 | A | | 6/1990 | Russo et al. | 424/47 |
| 4,940,171 | A | | 7/1990 | Gilroy | 222/402.18 |
| 5,068,099 | A | | 11/1991 | Sramek | 424/47 |
| 5,082,652 | A | | 1/1992 | Mayfield et al. | 424/47 |
| 5,083,683 | A | * | 1/1992 | Knickerbocker | 222/382 |
| 5,125,546 | A | | 6/1992 | Dunne et al. | 222/394 |
| 5,211,317 | A | | 5/1993 | Diamond et al. | 222/394 |
| 5,304,368 | A | | 4/1994 | Shernov et al. | 424/47 |
| 5,314,097 | A | | 5/1994 | Smrt et al. | 222/402.1 |
| 5,340,871 | A | | 8/1994 | Pearson et al. | 523/526 |
| 5,348,992 | A | | 9/1994 | Pearson et al. | 523/523 |
| 5,467,902 | A | | 11/1995 | Yquel | 222/402.1 |
| 5,518,151 | A | | 5/1996 | Knickerbocker | 222/382 |
| 5,586,695 | A | | 12/1996 | Labus et al. | 222/396 |
| 5,603,919 | A | | 2/1997 | Liu et al. | 424/47 |
| 5,626,840 | A | | 5/1997 | Thomaides et al. | 424/70.11 |
| 5,639,441 | A | | 6/1997 | Sievers et al. | 424/9.3 |
| RE35,843 | E | | 7/1998 | Diamond et al. | 222/394 |
| 5,939,060 | A | * | 8/1999 | Trinh et al. | 424/76.4 |
| 5,957,341 | A | | 9/1999 | Schiestel | 222/394 |
| 5,975,356 | A | | 11/1999 | Yquel et al. | 222/54 |
| 5,988,455 | A | | 11/1999 | Pearson et al. | 222/402.1 |
| 6,112,633 | A | * | 9/2000 | Trocino | 86/50 |
| 6,173,907 | B1 | | 1/2001 | Benoist | 239/337 |
| 6,199,766 | B1 | | 3/2001 | Fox et al. | 239/3 |
| 6,260,738 | B1 | * | 7/2001 | Kerr et al. | 222/402.13 |
| 6,352,582 | B1 | * | 3/2002 | Brown | 106/3 |
| 6,357,633 | B1 | | 3/2002 | Zimmerhackel et al. | 222/402.1 |
| 6,358,893 | B1 | | 3/2002 | Zechman, III et al. | 508/215 |
| 6,375,049 | B1 | | 4/2002 | Geier | 222/402.1 |
| 6,394,321 | B1 | | 5/2002 | Bayer | 222/402.24 |
| 6,482,357 | B1 | * | 11/2002 | Fox et al. | 422/4 |
| 6,824,079 | B1 | * | 11/2004 | Kendrick et al. | 239/343 |

FOREIGN PATENT DOCUMENTS

| | | | |
|---|---|---|---|
| JP | 56-133065 | | 10/1981 |
| JP | 59-84801 | | 5/1984 |
| JP | 59-84802 | | 5/1984 |
| JP | 59-93001 | | 5/1984 |
| JP | 59-93002 | | 5/1984 |
| JP | 61-165320 | | 7/1986 |
| JP | 61161164 | | 7/1986 |
| JP | 2-294382 | | 12/1990 |
| JP | 02294382 | | 12/1990 |
| JP | 3-148212 | | 6/1991 |
| JP | 3-157328 | | 7/1991 |
| JP | 03157328 | | 7/1991 |
| JP | 5-42797 | | 2/1993 |
| JP | 405042979 | A * | 2/1993 |
| JP | 9-67204 | | 3/1997 |
| JP | 2000316471 | | 11/2000 |

OTHER PUBLICATIONS

Patent Abstracts of Japan, vol. 015, No. 068 (C-0807), Feb. 18, 1991.

Patent Abstracts of Japan, vol. 010, No. 366 (C-390), Dec. 6, 1986.

Patent Abstracts of Japan, vol. 2000, No. 14, Mar. 5, 2001.

U.S. Appl. No. 10/350,011, Kendrick et al., Aerosol Dispenser Assembly and Method Of Reducing the Particle Size of a Dispensed Product, filed Jan. 24, 2003, pp. 1-16.

Non-Final Office Action in U.S. Appl. No. 10/350,011, dated Feb. 20, 2004, Examiner Ali.

Joint Declaration of Richard S. Valpey III, Cary E. Manderfield, and Paul A. Clark, Apr. 27, 2004, pp. 1-6.

* cited by examiner

AEROSOL DISPENSER ASSEMBLY HAVING LOW VOLATILE ORGANIC COMPOUND (VOC) CONTENT

This application is a continuation-in-part of U.S. patent application Ser. No. 10/350,011, entitled Aerosol Dispenser Assembly and Method of Reducing the Particle Size of a Dispensed Product, which was filed on Jan. 24, 2003, now U.S. Pat. No. 6,824,079.

FIELD OF THE INVENTION

Our invention relates generally to the field of aerosol dispenser assemblies. More specifically, our invention relates to the field of aerosol dispenser assemblies using a liquefied gas propellant to expel a liquid product from a container.

BACKGROUND OF THE INVENTION

Aerosol dispensers have been commonly used to dispense personal, household, industrial, and medical products, and provide a low cost, easy to use method of dispensing such products. Typically, aerosol dispensers include a container, which contains a liquid product to be dispensed, such as soap, insecticide, paint, deodorant, disinfectant, air freshener, or the like. A propellant is used to discharge the liquid product from the container. The propellant is pressurized and provides a force to expel the liquid product from the container when a user actuates the aerosol dispenser by, for example, pressing an actuator button.

The two main types of propellants used in aerosol dispensers today are liquefied gas propellants, such as hydrocarbon and hydrofluorocarbon (HFC) propellants, and compressed gas propellants, such as compressed carbon dioxide or nitrogen gas. To a lesser extent, chlorofluorocarbon propellants (CFCs) are also used. The use of CFCs is, however, being phased out due to the potentially harmful effects of CFCs on the environment.

In an aerosol dispenser using the liquefied gas-type propellant, the container is loaded with the liquid product and propellant to a pressure approximately equal to, or slightly greater than, the vapor pressure of the propellant. Thus filled, the container still has a certain amount of space that is not occupied by liquid. This space is referred to as the "head space" of the dispenser assembly. Since the container is pressurized to approximately the vapor pressure of the propellant, some of the propellant is dissolved or emulsified in the liquid product. The remainder of the propellant is in the vapor phase and fills the head space. As the product is dispensed, the pressure in the container remains approximately constant as liquid propellant evaporates to replenish discharged vapor. In contrast, compressed gas propellants are present entirely in the vapor phase. That is, no portion of a compressed gas propellant is in the liquid-phase. As a result, the pressure within a compressed gas aerosol dispenser assembly decreases as the vapor is dispensed.

A conventional aerosol dispenser is illustrated in FIG. 3, and generally comprises a container (not shown) for holding a liquid product and a propellant, and a valve assembly for selectively dispensing a liquid product from the container. As illustrated in FIG. 3, the valve assembly comprises a mounting cup 106, a mounting gasket 108, a valve body 110, a valve stem 112, a stem gasket 114, an actuator cap 116, and a return spring 118. The valve stem 112, stem gasket 114, and return spring 118 are disposed within the valve body 110 and are movable relative to the valve body 110 to selectively control dispensing of the liquid product. The valve body 110 is affixed to the underside of the mounting cup 106, such that the valve stem 112 extends through, and projects outwardly from, the mounting cup 106. The actuator cap 116 is fitted onto the outwardly projecting portion of the valve stem 112 and is provided with an exit orifice 132. The exit orifice 132 directs the spray of the liquid product into the desired spray pattern. A dip tube 120 is attached to the lower portion of the valve body 110 to supply the liquid product to the valve assembly to be dispensed. In use, the whole valve assembly is sealed to the container about its periphery by mounting gasket 108.

In operation, when the actuator cap 116 is depressed, the valve stem 112 is unseated from the mounting cup 106, which unseals the stem orifice 126 from the stem gasket 114 and allows the propellant to flow from the container, through the valve stem 112. Flow occurs because propellant forces the liquid product up the dip tube 120 and into the valve body 110 via a body orifice 122. In the valve body 110, the liquid product is mixed with additional propellant supplied to the valve body 110 through a vapor tap 124. The vapor tap 124 introduces additional propellant gas into the valve body 110, in order to help prevent flashing of the liquefied propellant, and to increase the amount of pressure drop across the exit orifice, which has the added benefit of further breaking-up the dispensed particles. From the valve body 110, the product is propelled through a stem orifice 126, out the valve stem 112, and through an exit orifice 132 formed in the actuator cap 116.

S. C. Johnson & Son, Inc. (S. C. Johnson) employs an aerosol valve similar to that shown in FIG. 3 in connection with their line of Glade® aerosol air fresheners. The propellant used to propel the air freshener liquid product from the container is a B-Series liquefied gas propellant having a propellant pressure of 40 psig (B-40), at 70 degrees F. (2.72 atm at 294 K). "Propellant pressure" refers to the approximate vapor pressure of the propellant, as opposed to "can pressure," which refers to the initial gauge pressure contained within a full aerosol container. The B-40 propellant is a composition of propane, normal butane, and isobutane. By normal butane it is meant the composition denoted by the chemical formula C4H10, having a linear backbone of carbon. This is in contrast to isobutane, which also has the chemical formula C4H10, but has a non-linear, branched structure of carbon. In order to effectively dispense this air freshener composition, the aerosol dispenser used by S. C. Johnson in connection with their line of Glade® aerosol air fresheners has a stem orifice diameter of 0.025" (0.635 mm), a vapor tap diameter of 0.020" (0.508 mm), a body orifice diameter of 0.062" (1.575 mm), and a dip tube inner diameter of 0.060" (1.524 mm). This current Glade® aerosol air freshener requires that the B-40 propellant be present in the amount of approximately 29.5% by weight of the contents of the dispenser assembly in order to satisfactorily dispense the air freshener liquid product.

Hydrocarbon propellants, such as B-40, contain Volatile Organic Compounds (VOCs). The content of VOCs in aerosol air fresheners is regulated by various federal and state regulatory agencies, such as the Environmental Protection Agency (EPA) and California Air Resource Board (CARB). S. C. Johnson continuously strives to provide environmentally friendly products and regularly produces products that exceed government regulatory standards. It is in this context that S. C. Johnson set out to produce an aerosol dispenser assembly having a reduced VOC content.

One way to reduce the VOC content in such aerosols is to reduce the amount of the propellant used to dispense the liquid product. However, we have discovered that a reduction in the propellant content adversely affects the product performance. Specifically, reducing the propellant content in the aerosol air freshener resulted in excessive product remaining in the container after the propellant is depeleted (product retention), an increase in the size of particles of the dispensed product (increased particle size), and a reduction in spray rate, particularly as the container nears depletion. It is desirable to minimize the particle size of a dispensed product in order to maximize the dispersion of the particles in the air and to prevent the particles from "raining" or "falling out" of the air. Thus, we set out to develop an aerosol dispenser assembly that can satisfactorily dispense an aerosol product that contains, at most, 25% by weight, of a liquefied gas propellant, while actually improving product performance throughout the life of the dispenser assembly.

The "life of the dispenser assembly" is defined in terms of the amount of propellant within the container (i.e., the can pressure), such that the life of the dispenser assembly is the period between when the pressure in the container is at its maximum (100% fill weight) and when the pressure within the container is substantially depleted, i.e., equal to atmospheric pressure. It should be noted that some amount of liquid product may remain at the end of the life of the dispenser assembly. As used herein, all references to pressure are taken at 70° F. (294 K), unless otherwise noted.

One known method of reducing the particle size of a dispensed liquid product is disclosed in U.S. Pat. No. 3,583,642 to Crowell et al. (the '642 patent), which is incorporated herein by reference. The '642 patent discloses a spray head that incorporates a "breakup bar" for inducing turbulence in a product/propellant mixture prior to the mixture being discharged from the spray head. Such turbulence contributes to reducing the size of the mixture particles discharged from the spray head.

SUMMARY OF THE INVENTION

Our invention provides an improved aerosol dispenser assembly that dispenses substantially all of a liquid product (i.e., reduces product retention) as a spray having a satisfactory particle size and spray rate, while at the same time reducing the amount of propellant required to dispense the liquid product from the container.

In one aspect, an aerosol dispenser assembly according to our invention comprises a container holding a liquid product and a liquefied gas propellant for propelling the liquid product from the container. The propellant is present in a quantity of at most about 25% by weight of the contents of the container. A valve is attached to the container for selectively dispensing the liquid product from the container as a mist. The assembly has a Clark/Valpey (CV) value of at most 25, where $CV=2.5(D-32)+10|Q-1.1|+2.6R$, D being the average diameter in micrometers of particles dispensed during the first forty seconds of spray of the assembly, Q being the average spray rate in grams/second during the first forty seconds of spray of the assembly, and R being the amount of the product remaining in the container at the end of the life of the assembly expressed as a percentage of the initial fill weight. Preferably, the propellant is present in a quantity of between about 10% and about 25% by weight of the contents of the container.

In another aspect, an aerosol dispenser assembly according to our invention comprises a container holding a liquid product and a liquefied gas propellant for propelling the liquid product from the container. The propellant is present in a quantity of at most about 25% by weight of the contents of the container. A valve is attached to the container for selectively dispensing the liquid product and the propellant from the container. The valve comprises a valve body and a valve stem. The valve body includes (i) a body orifice having a diameter of between about 1.270 and about 1.575 millimeters, for flow of the liquid product and propellant during dispensing, and (ii) a vapor tap having a diameter of between about 0.254 and about 0.483 millimeters, for introducing additional propellant gas through the valve body. The valve stem is disposed in the valve and defines at least one stem orifice having a total area of at least about 0.203 square millimeters, for flow of the liquid product and propellant during dispensing. A dispenser cap is coupled to the valve stem for actuating the valve to dispense the liquid product. The dispenser cap also defines an exit orifice having a diameter of between about 0.330 and about 0.635 millimeters, through which the liquid product and the propellant are dispensed.

In yet another aspect, an aerosol dispenser assembly according to our invention comprises a container holding a liquid product and a liquefied gas propellant for propelling the liquid product from the container. The propellant is present in a quantity of at most about 25% by weight of the contents of the container. A valve is attached to the container for selectively dispensing the liquid product and the propellant from the container. The valve comprises a valve body and a valve stem. The valve body includes (i) a body orifice having a diameter of between about 0.254 and about 0.635 millimeters, for flow of the liquid product and propellant during dispensing, and (ii) a vapor tap having a diameter of between about 0.076 and about 0.254 millimeters, for introducing additional propellant gas through the valve body. The valve stem is disposed in the valve and defines at least one stem orifice having a total area of at least about 0.405 square millimeters, for flow of the liquid product and propellant during dispensing. A dispenser cap is coupled to the valve stem for actuating the valve to dispense the liquid product. The dispenser cap also defines an exit orifice having a diameter of between about 0.330 and about 0.635 millimeters, through which the liquid product and the propellant are dispensed.

In still another aspect, an aerosol dispenser assembly according to our invention comprises a container holding a liquid product and a liquefied gas propellant for propelling the liquid product from the container. The propellant is present in a quantity of at most about 15% by weight of the contents of the container. A valve is attached to the container and is capable of selectively dispensing the liquid product and the propellant from the container as a mist having a particle size in the range of about 15 micrometers to about 60 micrometers at a rate of between about 0.6 and about 1.8 grams/second, at least during the first forty seconds of spraying time of the life of the assembly.

Average particle size, as used herein, means average mean particle size D(V,0.5) of the dispensed product, as measured by laser diffraction analysis by a Malvern® Mastersizer 2600 Particle Size Analyzer, the aerosol assemblies being sprayed from a horizontal distance of 11–16.0" (27.5–40.6 cm) from the measurement area, and having a maximum cutoff size of 300 microns. This term is equivalent to mass mean particle size.

As used herein to describe any quantity, dimension, range, value, or the like, the term "about" is intended to encompass the range of error that occurs during any measurement, variations resulting from the manufacturing process, variation due to deformation during or after assembly, or variation that is the compounded result of one or more of the foregoing factors.

A better understanding of these and other aspects, features, and advantages of the invention may be had by reference to the drawings and to the accompanying description, in which preferred embodiments of the invention are illustrated and described.

BRIEF DESCRIPTION OF THE DRAWINGS

Throughout the figures, like or corresponding reference numerals denote like or corresponding parts.

DESCRIPTION OF THE PREFERRED EMBODIMENTS

Figure 2:
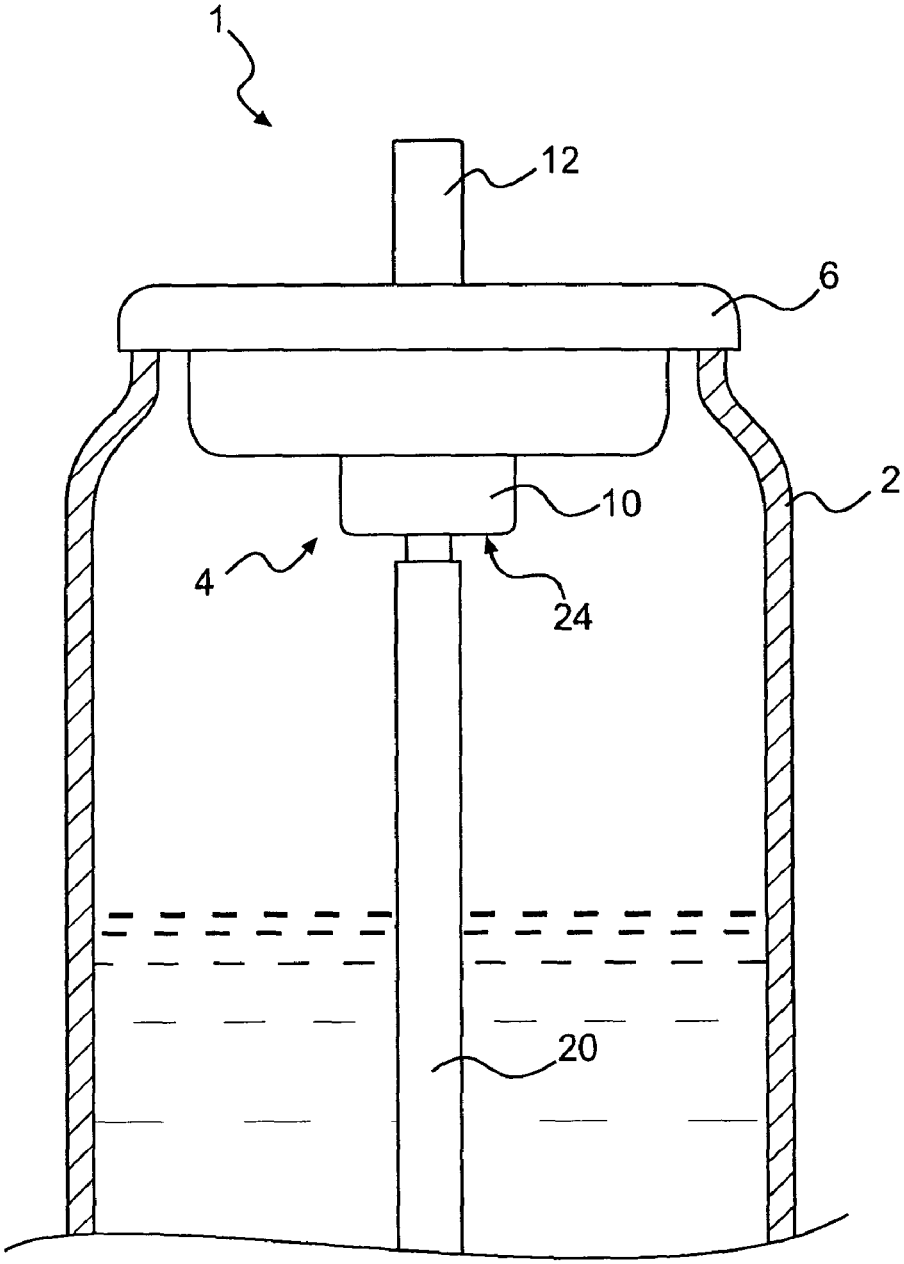
FIG. 2 is a front view of the aerosol dispenser assembly of the first embodiment, with the container cut away for clarity.
Figure 3:
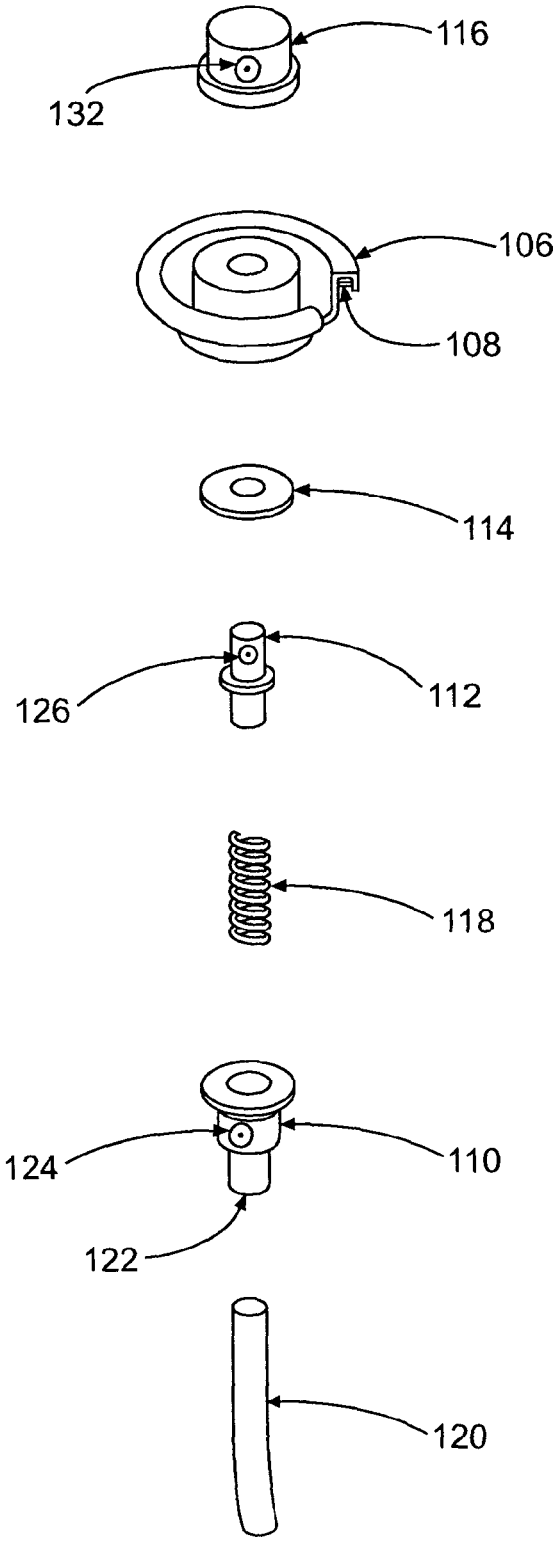
FIG. 3 PRIOR ART
FIG. 3 is an exploded view of a conventional aerosol valve assembly and actuator cap, illustrating the individual components.

As shown in FIG. 2, an aerosol dispenser assembly according to our invention generally comprises a container 2 with a valve assembly 4 disposed in the top thereof for selectively dispensing a liquid product from the container 2.

Figure 1:
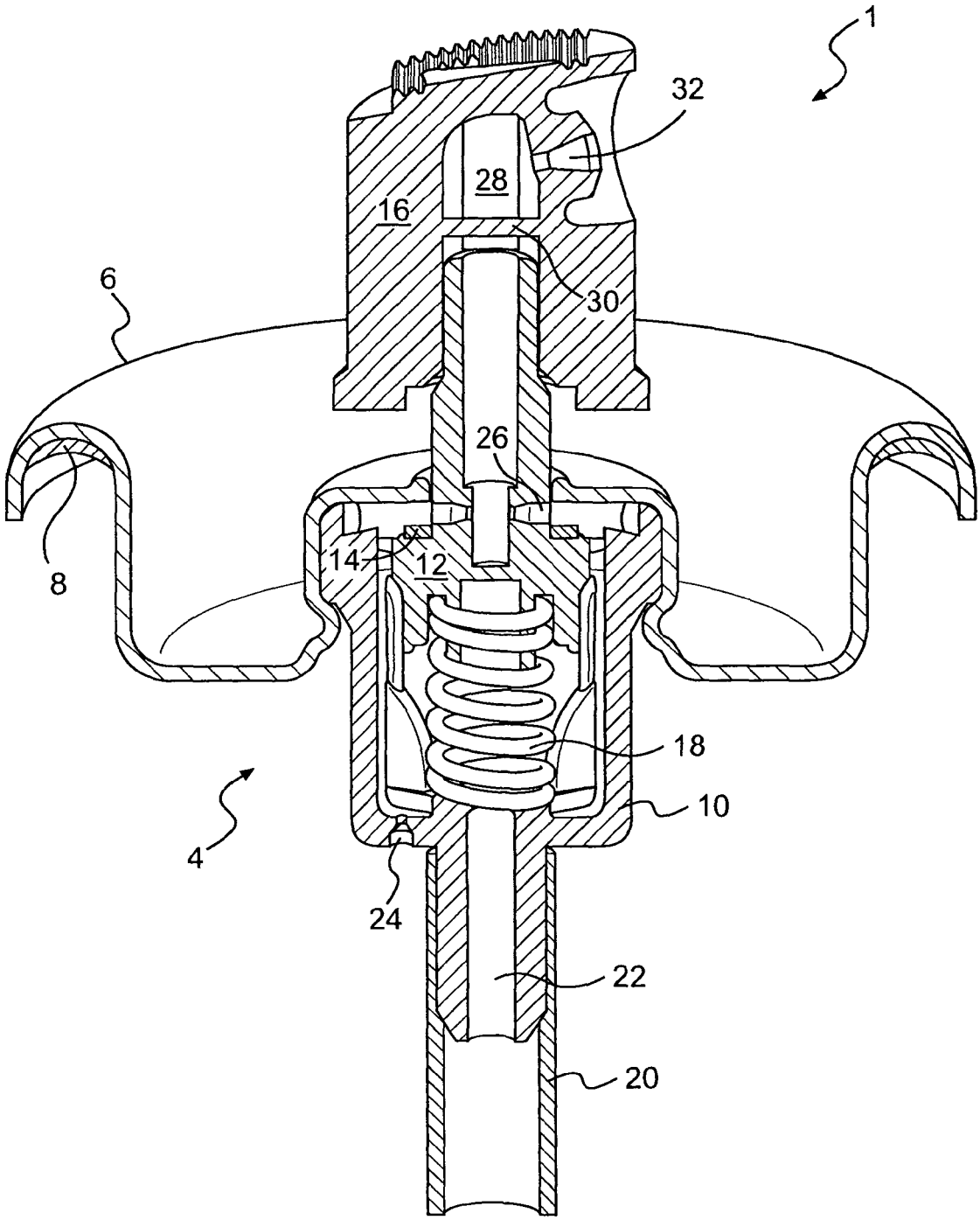
FIG. 1 is a cross-sectional perspective view of a first embodiment of the valve of the present invention.

With reference to FIG. 1, the valve assembly 4 further comprises a mounting cup 6, a mounting gasket 8, a valve body 10, a valve stem 12, a stem gasket 14, an actuator cap 16, and a return spring 18. The actuator cap 16 defines an exit path 28 and an actuator orifice 32. The valve stem 12, stem gasket 14, and return spring 18 are disposed within the valve body 10 and are movable relative to the valve body 10. The valve body 10 is affixed to the underside of the mounting cup 6, such that the valve stem 12 extends through, and projects outwardly from, the mounting cup 6. The actuator cap 16 is fitted onto the outwardly projecting portion of the valve stem 12, and a dip tube 20 is attached to the lower portion of the valve body 10. The whole valve assembly 4 is sealed to the container 2 by mounting gasket 8.

While the dispenser assembly shown in FIG. 1 employs a vertical action-type cap 16, it will be understood that any suitable valve type may be used, such as, for example, a tilt action-type cap. In addition, instead of the simple push-button actuator cap 16 shown in FIG. 1, it will be understood that any suitable actuator may be used, such as, for example, an actuator button with an integral overcap, a trigger actuated assembly, or the like.

In operation, when the actuator cap 16 of the dispenser 1 is depressed, it forces the valve stem 12 to move downward, thereby allowing the liquid product to be dispensed. The propellant forces the liquid product up the dip tube 20 and into the valve body 10 via body orifice 22. In the valve body 10, the liquid product is mixed with additional propellant supplied to the valve body 10 through a vapor tap 24. The additional propellant introduced through the vapor tap 24 prevents flashing of the liquefied propellant, and increases the amount of pressure drop across the exit orifice which simultaneously increase the particle break-up. From the valve body 10, the liquid product is propelled through at least one stem orifice 26, out the valve stem 12, and through an exit path 28 formed in the actuator cap 16. A single stem orifice may be used; however, we have found that using two (as shown in FIG. 1), or preferably four, stem orifices 26 spaced around the periphery of the valve body 10 facilitates greater flow and superior mixing of the product as it is dispensed.

FIG. 1 depicts a breakup bar 30 in the exit path 28, such that the product is forced to diverge around the breakup bar 30, thereby inducing turbulence in the flow of the product, further reducing the particle size of the product. The product is then expelled from the actuator cap 16 through an actuator orifice 32, which disperses the product and produces a desired spray pattern. Instead of a breakup bar as shown in FIG. 1, the dispenser assembly might employ a pair of breakup plates positioned in or below the exit path 28, a swirl chamber positioned immediately upstream of the exit orifice 32, or other similar mechanical breakup features. While mechanical breakup features provide some additional break-up of the product prior to being dispensed, we have found that other factors have a much greater impact on particle size than these mechanical breakup features. Nonetheless, these mechanical breakup features may be used to even further reduce the size of the dispensed particles, but such mechanical breakup features are not necessary or preferred.

As noted above, we found that reducing the hydrocarbon propellant content of an aerosol air freshener to at most 25% by weight adversely affected the product performance. Specifically, reducing the propellant content in the aerosol air freshener resulted in excessive product retention, decreased spray rate as the container became depleted, and an increased particle size. Consequently, the air freshener exhibited excessive raining or falling out of the liquid product. In order to correct these adverse effects, we tested various different types of propellants, pressures, and valve orifice dimensions.

In particular, we tested two types of propellants, A-Series and B-Series propellants. Both types of propellants were found to be suitable for dispensing a liquid product from a container. We found, however, that the A-Series propellants that we tested unexpectedly produced a mist having a significantly smaller particle size than did the B-series propellants, under the same conditions. This difference was especially pronounced toward the end of the life of the dispenser assembly, when the pressure remaining in the container was lower. We believe that the superior mist producing ability of the A-Series propellants is due to the absence of normal butane in the A-Series propellants. As described above, the B-Series propellants contain a combination of propane, normal butane, and isobutane. In contrast, the A-series propellant does not contain any normal butane. When the dispenser assembly is shaken prior to use, the liquid product and the propellant form an oil-out emulsion. That is, small droplets of the liquid product are coated with a layer of fragrance oil and propellant, the aqueous phase liquid product being suspended in a layer of non-aqueous phase propellant and fragrance oil. When the emulsion is expelled from the pressurized dispenser assembly, the liquefied gas instantly evaporates, causing the droplets to "burst" and creating a fine mist of liquid product in the air. The absence of normal butane in the A-Series propellant is thought to facilitate a greater burst of mist, thereby reducing the particle size of the dispensed mist. This reduced particle size allows a greater amount of the dispensed product to remain suspended in the air for a longer period of time, thus, increasing the air freshening efficacy of the product.

While the invention is disclosed as being primarily used in connection with a hydrocarbon propellant, it should be understood that the invention could be adapted for use with other sorts of propellants. For example, HFC, dimethyl ether (DME), and CFC propellants might also be used in connection with a variation of the dispenser assembly of our invention.

In addition, we tested various different propellant pressures and found that, in general, higher-pressure propellants tended to dispense the product as a mist having smaller particle size than did lower-pressure propellants. In addition, the higher-pressure propellants somewhat reduced the amount of product retained in the container at the end of the life of the dispenser assembly. However, simply increasing the pressure in the prior art aerosol dispensers, without more, was found to be insufficient to expel a satisfactory amount of the liquid product from the container. Thus, we also examined the aerosol valve itself to determine how best to reduce the amount of product retention, while maintaining a satisfactorily small particle size of the dispensed product.

In order to minimize the amount of product retention of the dispenser assembly, we found that it was desirable to increase the amount of liquid product dispensed per unit of propellant. That is, by making the dispensed ratio of liquid product to propellant smaller (i.e., creating a leaner mixture), the same amount of propellant will be able to exhaust a greater amount of liquid product. Several valve components are known to affect the dispensed ratio of liquid product to propellant, the vapor tap, the stem orifice, the body orifice, the exit orifice, and the inner diameter of the dip tube.

In general, we found that decreasing the size of the vapor tap has the effect of creating a leaner mixture. However, reducing the size of the vapor tap also has the side effect of increasing the particle size of the dispensed product. Conversely, we found that decreasing the size of the stem orifice, body orifice, exit orifice and/or dip tube inner diameter generally decreases the spray rate and the particle size.

Based on the foregoing experimentation and analysis, we discovered that certain combinations of propellant type, can pressure, and valve orifice dimensions, produced a dispenser assembly that contains at most 25% by weight of a hydrocarbon propellant and has superior product performance over the prior art dispenser assemblies.

We also found that A-Series propellants, which are free from normal butane, exhibit reduced particle size of the dispensed product.

A dispenser assembly having a can pressure of between 55 psig (3.74 atm) and 120 psig (8.17 atm) was found to help reduce product retention while also reducing the particle size of the dispensed product. As noted above, can pressure refers to the initial gauge pressure contained within the aerosol container. Still higher pressures could also be effectively used to dispense the liquid product from the container. As the pressure within the aerosol dispenser assembly is increased, however, the strength of the aerosol dispenser container (also referred to as an aerosol can) must also be increased. Federal regulations (DOT ratings) govern the strength of pressurized containers and specify that aerosol cans must meet a certain can rating for a given internal pressure. Specifically, aerosol cans having an internal pressure of 140 psig or less at 130° F. (9.53 atm at 327 K) are known as "regular" or "unrated," since a higher DOT rating is not required. Aerosol cans having an internal pressure of 160 psig or less at 130° F. (10.9 atm at 344 K) have a DOT rating of 2P, and cans having an internal pressure of 180 psig or less at 130° F. (12.3 atm at 355 K) have a DOT rating of 2Q. The higher the specified can rating, the stronger the aerosol can must be. Generally, a can having a higher rating will be more costly due to increased material and/or manufacturing costs. Thus, in order to minimize costs, it is preferable to use the lowest pressure possible while still maintaining satisfactory product performance. In this regard, we found that can pressures of between 55 psig (3.74 atm) and 80 psig (5.44 atm), again measured at 70 degrees F. (294 K), were especially preferred because they require a lower can rating than would higher can pressures and are still capable of achieving the advantages of the present invention (i.e., reduced propellant content, reduced particle size, and minimal product retention).

We also found that the dispenser assembly of FIG. 1 was capable of satisfactorily dispensing an aerosol product that contains at most 25% by weight of a liquefied gas propellant, when the diameter of the vapor tap 24 is between about 0.013" (0.330 mm) and about 0.019" (0.483 mm), the diameter of the stem orifice 26 is between about 0.020" (0.508 mm) and about 0.030" (0.762 mm) when a single stem orifice is used (between about 0.014" (0.356 mm) and about 0.025" (0.635 mm) when a pair of stem orifices are used), the diameter of the body orifice is between about 0.050" (1.270 mm) and about 0.062" (1.575 mm), the diameter of the exit orifice 32 is between about 0.015" (0.381 mm) and about 0.022" (0.559 mm), and the inner diameter of the dip tube is between about 0.040" (1.016 mm) and about 0.060" (1.524 mm).

Thus, any of the above-described valve components, propellant types, propellant pressures, and valve orifice dimensions, may be used in combination to provide a dispenser assembly according to our invention.

In a first preferred embodiment of the invention, the aerosol dispenser assembly 1 uses an A-Series propellant having a propellant pressure of about 60 psig (4.1 atm) (i.e., A-60 propellant) to dispense the liquid product from the container 2. In this embodiment, the container is initially pressurized to a can pressure of about 70 psig (4.8 atm) to about 80 psig (5.4 atm). The diameter of the vapor tap 24 in this embodiment is about 0.016" (0.406 mm). Two stem orifices 26 are used, each having a diameter of about 0.024" (0.610 mm). The diameter of the body orifice is about 0.050" (1.270 mm), the diameter of the exit orifice 32 is about 0.020" (0.508 mm), and the inner diameter of the dip tube is about 0.060" (1.52 mm). Furthermore, a breakup bar 30 is positioned in the exit path 28 of the actuator 16 in order to further reduce the particle size of the dispensed product.

A second preferred embodiment of the dispenser assembly 1 employs a single stem orifice 26. In this embodiment, the dispenser assembly 1 also uses the A-60 propellant and a can pressure of about 70 psig (4.8 atm) to about 80 psig (5.4 atm) to dispense the liquid product from the container 2. The diameter of the vapor tap is about 0.016" (0.406 mm), the diameter of the single stem orifice is about 0.025" (0.635 mm), the diameter of the body orifice is about 0.062" (1.575 mm), and the inner diameter of the dip tube is about 0.060" (1.524 mm). This embodiment also employs a breakup bar, positioned in the exit path of the actuator to further reduce the particle size of the dispensed product. The following table T.1 describes the performance of the dispenser assemblies according to the first and second preferred embodiments, respectively.

TABLE 1

Performance of Embodiments One and Two

| Propellant Type | A-60 | A-60 |
|---|---|---|
| Propellant Level (wt. %) | 24.5 | 24.5 |
| Body Orifice Diameter (mm) | 1.58 | 1.27 |
| Vapor Tap Diameter (mm) | 0.406 | 0.406 |
| Stem Orifice Area ($mm^2$) | 0.317 | 0.584 |
| Exit Orifice Diameter (mm) | 0.508 | 0.508 |
| Dip Tube Diameter (mm) | 1.52 | 1.52 |
| Mechanical Breakup | Yes | Yes |
| Spray Rate (g/s) 100% Full | 1.23 | 1.27 |
| 75% Full | 1.18 | 1.15 |
| 50% Full | 1.15 | 1.12 |
| 25% Full | 1.07 | 1.05 |
| Particle Size ($\mu$m) 100% Full | 29 | 29 |
| 75% Full | 30 | 30 |
| 50% Full | 29 | 32 |
| 25% Full | 32 | 34 |
| Retention (wt. %) | 1.26 | 1.76 |

These preferred embodiments of the dispenser assembly are capable of dispensing the liquid product contained within the container as a mist having an average particle size of less than 35 micrometers (0.0014"), over at least 75% of the life of the dispenser assembly. Because the dispensed mist has such a small particle size, the particles are more easily dispersed in the air and less fallout is experienced. This reduction in the amount of fallout increases the dispenser assembly's air freshening efficacy and helps to prevent undesirable residue of the liquid product from settling on flat surfaces, such as, countertops, tables, or floors.

Moreover, both preferred embodiments of the dispenser assembly are capable of dispensing over 98% by weight of the liquid product from the container. It is important that substantially all of the product can be dispensed, to ensure that product label claims will be met. Also, by minimizing the amount of product retained in the container at the end of the life of the dispenser assembly, less liquid product is wasted. This is important from a consumer satisfaction standpoint, since consumers tend to be more satisfied with a dispenser assembly when substantially all of the liquid product can be dispensed.

With the foregoing preferred embodiments as a threshold, we began to take a more focused approach to reducing the propellant content of a dispenser assembly even further. Our goal at this stage was to produce an aerosol dispenser assembly that could effectively dispense its contents using as little propellant as possible, but not more than about 15% liquefied gas propellant by weight. At the outset, we note that as the propellant content was reduced below about 15%, the stability of the product propellant emulsion began to break down. That is, at lower propellant levels, the oil-out emulsion inverted to a water-out emulsion, thereby deteriorating the performance characteristics. In contrast to an oil-out emulsion, a water-out emulstion contains small droplets of a non-aqueous phase suspended in an aqueous phase. We found that this inversion can be prevented by adjusting the emulsifier. For example, lowering the liquefied gas propellant level from 25% to 10% inverted the emulsion. Addition of 0.03% by weight of trimethyl stearyl ammonium chloride prevented the inversion. Of course, various other stabilizers in various different amounts may also be effectively used to prevent the inversion of the emulsion.

We first identified several "performance characteristics" upon which to measure the performance of a given dispenser assembly configuration. The performance characteristics identified were (1) the average diameter D in micrometers of particles dispensed during the first forty seconds of spray of the assembly, (2) the average spray rate Q in grams/second during the first forty seconds of spray of the assembly, and (3) the amount of the product R remaining in the container at the end of the life of the assembly, expressed as a percentage of the initial fill weight. As used herein, the term "fill weight" refers to the weight of all of the contents of the container, including both the liquid product and the propellant.

Based on consumer testing and air freshening efficacy, the particle size, D, should preferably be in the range of about 15 and about 60 micrometers, more preferably between about 25 and about 40 micrometers, and most preferably between about 30 and about 35 micrometers. The spray rate is preferably between about 0.6 and about 1.8 g/s, more preferably between about 0.7 and about 1.4 g/s, and most preferably between about 1.0 and about 1.3 g/s. The amount of liquid product remaining in the can at the end of life of the dispenser assembly is preferably less than about 3% of the initial fill weight, more preferably less than about 2% of the initial fill weight, and most preferably less than about 1% of the initial fill weight.

Figure 4:
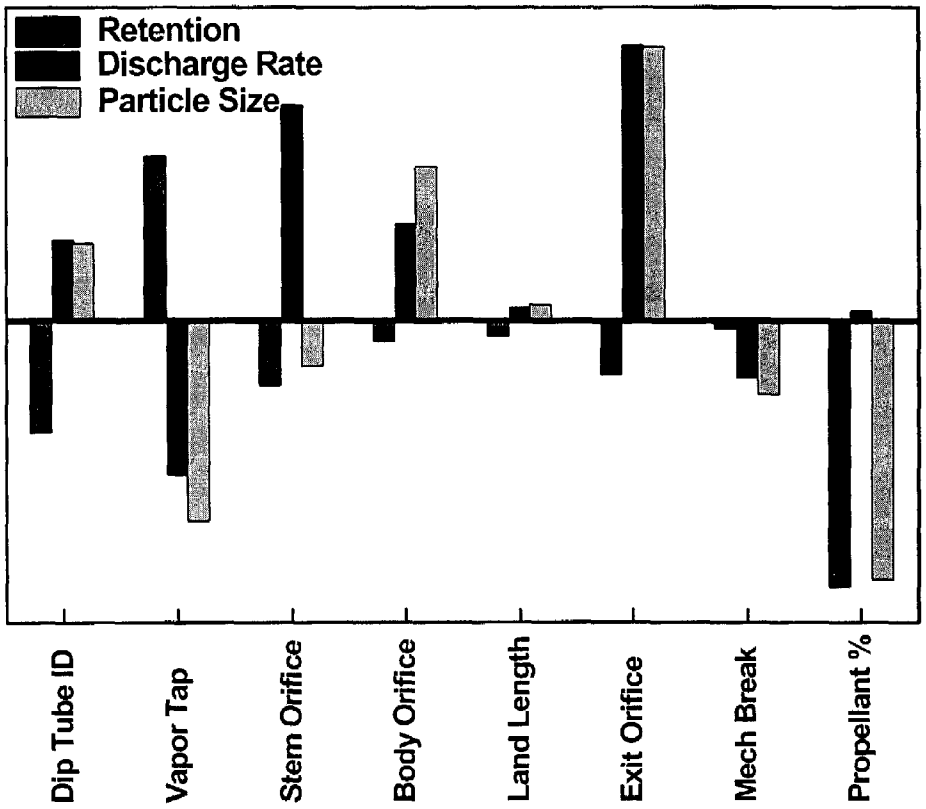
FIG. 4 is a graph representing calculations performed according to preferred embodiments of the invention.

Next, we determined all of the factors that were known, or thought, to affect one or more of these performance characteristics. These factors included propellant content, dip tube inner diameter, body orifice diameter, vapor tap diameter, stem orifice diameter, mechanical breakup elements, exit orifice diameter, and land length (essentially the axial length of the exit orifice). Initial experiments were conducted, varying each of these factors individually, to determine the magnitude of the effect each factor had on the performance characteristics. The control platforms used for the initial testing were the original Glade dispenser assembly and the above-described first and second preferred embodiments. One or more of these platforms was then modified to vary each of the above factors individually. The magnitude of the effect each factor had on the performance characteristics was determined using a $2^k$ factorial experimental design. The results of these calculations are shown graphically in FIG. 4.

From this list we selected the five factors ("critical factors") having the greatest effect (negative or positive) on the performance characteristics to perform further experimentation. The critical factors selected were dip tube inner diameter, vapor tap diameter, body orifice diameter, stem orifice diameter, and exit orifice diameter.

While we knew that the critical factors had a pronounced effect on the performance characteristics, we were unsure if they varied independently of one another. To determine interdependencies, it was necessary to generate a table showing performance characteristics for every combination of every value of the critical factors within a desired range.

If each of the critical factors was varied through ten different sizes, it would have required one hundred thousand different trials to complete the table referred to above. Rather than run all of those different experiments, we used a Response Surface Method to select a limited sample of experiments. Based on our limited sample of experiments, we were able to generate a complete table of performance characteristics for every possible variation of the critical factors, using the Response Surface Method to interpolate the missing data points. Fifty-seven experiments were conducted—a Box-Behnken Design consisting of twenty-nine experiments, the results of which are set forth in table T.2 below, and a D-Optimal Design consisting of twenty eight experiments, the results of which are set forth in table T.3 below. Descriptions of these two methods can be found in statistic text books such as "Design and Analysis of Experiments" by Doulas C. Montgomery, published by John Wiley and Sons, New York, 1997.

TABLE 2

Experimental Data for Box-Behnken Design

| Trial | Exit Orifice (mm) | Vapor Tap (mm) | Dip Tube ID (mm) | Body Orifice (mm) | Particle Size Full (μm) | Particle Size Fill Weight (μm) | @ 200 g Rate Full (g/s) | @ 200 g Fill Weight (g/s) | Retention (Wt. %) | CV |
|---|---|---|---|---|---|---|---|---|---|---|
| 1 | 0.635 | 0.330 | 3.099 | 0.635 | 40.0 | 47.9 | 1.408 | 1.360 | 1.62 | 27 |
| 2 | 0.330 | 0.127 | 1.524 | 0.635 | 40.0 | 38.4 | 0.716 | 0.588 | 2.70 | 31 |
| 3 | 0.635 | 0.127 | 1.524 | 0.635 | 44.7 | 47.7 | 1.451 | 1.349 | 0.00 | 35 |
| 4 | 0.457 | 0.330 | 1.524 | 0.635 | 34.7 | 36.7 | 0.877 | 0.676 | 10.23 | 36 |
| 5 | 0.457 | 0.508 | 1.016 | 0.635 | 21.7 | 89.4 | 0.555 | 0.947 | 22.59 | 38 |
| 6 | 0.457 | 0.330 | 1.524 | 0.635 | 34.6 | 37.4 | 0.847 | 0.599 | 17.34 | 54 |
| 7 | 0.457 | 0.330 | 1.524 | 0.635 | 33.8 | 38.6 | 0.860 | 0.599 | 19.34 | 57 |
| 8 | 0.457 | 0.330 | 1.016 | 0.330 | 26.9 | 62.9 | 0.618 | 0.487 | 23.59 | 53 |
| 9 | 0.457 | 0.127 | 1.524 | 0.330 | 33.8 | 41.2 | 0.716 | 0.639 | 1.78 | 13 |
| 10 | 0.457 | 0.508 | 3.099 | 0.635 | 29.1 | 40.7 | 0.666 | 0.390 | 33.55 | 84 |
| 11 | 0.330 | 0.330 | 3.099 | 0.635 | 35.2 | 33.6 | 0.567 | 0.422 | 17.22 | 58 |
| 12 | 0.457 | 0.127 | 3.099 | 0.635 | 47.8 | 48.1 | 1.282 | 1.187 | 0.00 | 41 |
| 13 | 0.330 | 0.330 | 1.016 | 0.635 | 27.5 | 55.1 | 0.431 | 0.418 | 33.40 | 82 |
| 14 | 0.457 | 0.330 | 1.524 | 0.635 | 34.9 | 38.2 | 0.826 | 0.641 | 6.60 | 27 |
| 15 | 0.457 | 0.127 | 1.016 | 0.635 | 41.3 | 41.3 | 1.018 | 0.868 | 0.15 | 24 |
| 16 | 0.330 | 0.330 | 1.524 | 1.270 | 34.7 | 27.3 | 0.565 | 0.317 | 30.08 | 90 |
| 17 | 0.330 | 0.330 | 1.524 | 0.330 | 23.1 | 46.2 | 0.353 | 0.413 | 33.59 | 72 |
| 18 | 0.330 | 0.508 | 1.524 | 0.635 | 22.7 | 44.3 | 0.357 | 0.492 | 35.37 | 76 |
| 19 | 0.457 | 0.127 | 1.524 | 1.270 | 50.0 | 48.2 | 1.357 | 1.200 | 0.00 | 48 |
| 20 | 0.457 | 0.330 | 3.099 | 0.330 | 26.8 | 64.9 | 0.618 | 0.538 | 23.71 | 54 |
| 21 | 0.457 | 0.330 | 1.524 | 0.635 | 35.1 | 38.5 | 0.904 | 0.751 | 13.05 | 44 |
| 22 | 0.635 | 0.508 | 1.524 | 0.635 | 30.8 | 51.5 | 0.975 | 0.748 | 31.04 | 79 |
| 23 | 0.457 | 0.330 | 3.099 | 1.270 | 46.1 | 43.8 | 1.186 | 0.982 | 0.00 | 36 |
| 24 | 0.635 | 0.330 | 1.524 | 1.270 | 42.0 | 49.1 | 1.354 | 1.043 | 0.83 | 30 |
| 25 | 0.457 | 0.508 | 1.524 | 0.330 | 27.3 | 61.0 | 0.620 | 0.479 | 26.33 | 61 |
| 26 | 0.457 | 0.330 | 1.016 | 1.270 | 29.1 | 50.5 | 0.723 | 0.390 | 32.74 | 82 |
| 27 | 0.635 | 0.330 | 1.524 | 0.330 | 34.4 | 45.5 | 0.731 | 0.398 | 39.11 | 111 |
| 28 | 0.635 | 0.330 | 1.016 | 0.635 | 36.6 | 52.2 | 1.043 | 0.719 | 19.65 | 63 |
| 29 | 0.457 | 0.508 | 1.524 | 1.270 | 27.2 | 56.8 | 0.671 | 0.790 | 28.73 | 67 |

TABLE 3

Experimental Data for D-Optimal Design

| Trial | Propellant Content (Wt. %) | Vapor Tap (mm) | Exit Orifice (mm) | Particle Size Full (μm) | Spray Rate Full (g/s) | Retention (Wt. %) |
|---|---|---|---|---|---|---|
| 1 | 14.5 | 0.508 | 0.330 | 20.0 | 0.323 | 22.15 |
| 2 | 13 | 0.635 | 0.508 | 22.3 | 0.489 | 21.15 |
| 3 | 19 | 0.635 | 0.635 | 27.4 | 0.972 | 18.63 |
| 4 | 13 | 0.406 | 0.330 | 26.7 | 0.404 | 30.46 |
| 5 | 19 | 0.127 | 0.330 | 39.8 | 0.760 | 0.00 |
| 6 | 17 | 0.635 | 0.457 | 18.6 | 0.528 | 21.18 |
| 7 | 13 | 0.330 | 0.635 | 43.9 | 1.182 | 10.82 |
| 8 | 17 | 0.457 | 0.406 | 26.9 | 0.593 | 20.18 |
| 9 | 19 | 0.330 | 0.330 | 29.4 | 0.503 | 13.15 |
| 10 | 19 | 0.635 | 0.457 | 20.1 | 0.511 | 16.72 |
| 11 | 13 | 0.127 | 0.330 | 42.0 | 0.764 | 0.00 |
| 12 | 15 | 0.127 | 0.635 | 45.8 | 1.542 | 0.00 |
| 13 | 19 | 0.127 | 0.457 | 42.6 | 1.079 | 0.09 |
| 14 | 19 | 0.457 | 0.508 | 28.0 | 0.788 | 16.62 |
| 15 | 17 | 0.127 | 0.457 | 44.7 | 1.149 | 0.00 |
| 16 | 14.5 | 0.254 | 0.330 | 40.7 | 0.727 | 9.04 |
| 17 | 19 | 0.127 | 0.635 | 42.0 | 1.514 | 0.00 |
| 18 | 17.5 | 0.508 | 0.584 | 28.4 | 0.942 | 11.54 |
| 19 | 13 | 0.635 | 0.635 | 34.0 | 0.958 | 27.13 |
| 20 | 13 | 0.406 | 0.330 | 26.1 | 0.407 | 28.98 |
| 21 | 13 | 0.635 | 0.635 | 31.4 | 0.733 | 31.06 |
| 22 | 16 | 0.406 | 0.635 | 33.6 | 1.152 | 10.11 |
| 23 | 16 | 0.406 | 0.508 | 30.5 | 0.843 | 18.36 |
| 24 | 17 | 0.635 | 0.508 | 23.2 | 0.629 | 16.90 |
| 25 | 15 | 0.635 | 0.635 | 26.7 | 0.810 | 27.08 |
| 26 | 17 | 0.127 | 0.406 | 43.1 | 1.012 | 0.00 |
| 27 | 13 | 0.127 | 0.330 | 42.4 | 0.775 | 2.36 |
| 28 | 19 | 0.635 | 0.508 | 19.6 | 0.560 | 21.04 |

Each of the characteristics, D, Q, and R, was then weighted according to a number of different considerations, including its relative effect on the acceptability of the dispenser assembly to the consumer. The weighting process was iterated sequentially, through trial and error, until minimum values were achieved for samples known to have the best performance. The acceptability of the dispenser assembly to a consumer is given as the "quality" of the dispenser assembly and is represented by the Clark/Valpey (CV) factor—smaller values of CV being more acceptable to consumers than larger ones. We found that, generally, a dispenser assembly having a quality value much greater than about 25 is unacceptable to most consumers. Accordingly, a dispenser assembly according to our invention should have a CV value of at most about 20, where $CV=2.5(D-32)+10|Q-1.1|+2.6R$.

At a propellant level of 14.5% by weight and using an actuator cap 16 with a swirl chamber, we found that the body orifice diameter should preferably be between about 0.010" (0.254 mm) and about 0.025" (0.635 mm), and more preferably between about 0.010" (0.254 mm) and about 0.015" (0.381 mm). The vapor tap diameter should preferably be between about 0.003" (0.076 mm) and about 0.010" (0.254 mm), and more preferably between about 0.005" (0.127 mm) and about 0.008" (0.203 mm). The at least one stem orifice should preferably have a total area of at least about 0.000628 $in^2$ (0.405 $mm^2$), and more preferably at least about 0.000905 $in^2$ (0.584 $mm^2$). The exit orifice diameter should preferably be between about 0.013" (0.330 mm) and about 0.025" (0.635 mm), and more preferably between about 0.015" (0.381 mm) and about 0.022" (0.559 mm). And the dip tube inner diameter should preferably be between about 0.040" (1.016 mm) and about 0.122" (3.099 mm), and more preferably between about 0.050" (1.270 mm) and about 0.090" (2.286 mm). Not every combination of the above valve orifice dimensions will result in an aerosol dispenser assembly having a quality value of at most 25. However, most aerosol valves of this type having a quality value of at most 25 will have orifice dimensions that fall within the above ranges. Because the performance characteristics are not directly proportional to any one of the critical factors, and because the critical factors are not independent of one another, it is difficult to determine what combination of valve dimensions will result in the optimum quality of the dispensed spray. The tables T.4-T.8 below show how quality changes as the critical factors are varied through a representative range of values around the preferred valve configuration.

TABLE 4

Variation of Body Orifice Diameter

| Vapor Tap (mm) | Body Orifice (mm) | Stem Orifice ($mm^2$) | Dip tube (mm) | Exit Orifice (mm) | D ($\mu$m) | Q (g/s) | R (wt. %) | CV |
|---|---|---|---|---|---|---|---|---|
| 0.127 | 0.330 | 1.824 | 1.524 | 0.457 | 36 | 0.72 | 0.58 | 15 |
| 0.127 | 0.457 | 1.824 | 1.524 | 0.457 | 46 | 1.08 | 0.46 | 36 |
| 0.127 | 0.635 | 1.824 | 1.524 | 0.457 | 48 | 1.17 | 0.54 | 42 |

TABLE 5

Variation of Vapor Tap Diameter

| Vapor Tap (mm) | Body Orifice (mm) | Stem Orifice ($mm^2$) | Dip tube (mm) | Exit Orifice (mm) | D ($\mu$m) | Q (g/s) | R (wt. %) | CV |
|---|---|---|---|---|---|---|---|---|
| 0.127 | 0.330 | 1.824 | 1.524 | 0.457 | 36 | 0.72 | 0.58 | 15 |
| 0.203 | 0.330 | 1.824 | 1.524 | 0.457 | 32 | 0.69 | 11.6 | 34 |
| 0.254 | 0.330 | 1.824 | 1.524 | 0.457 | 31 | 0.68 | 14.7 | 40 |

TABLE 6

Variation of Exit Orifice Diameter

| Vapor Tap (mm) | Body Orifice (mm) | Stem Orifice ($mm^2$) | Dip tube (mm) | Exit Orifice (mm) | D ($\mu$m) | Q (g/s) | R (wt. %) | CV |
|---|---|---|---|---|---|---|---|---|
| 0.127 | 0.330 | 1.824 | 1.524 | 0.330 | 31 | 0.43 | 10.8 | 32 |
| 0.127 | 0.330 | 1.824 | 1.524 | 0.381 | 33 | 0.63 | 5.8 | 22 |
| 0.127 | 0.330 | 1.824 | 1.524 | 0.457 | 36 | 0.72 | 0.58 | 15 |
| 0.127 | 0.330 | 1.824 | 1.524 | 0.559 | 35 | 0.83 | 5.9 | 26 |
| 0.127 | 0.330 | 1.824 | 1.524 | 0.635 | 38 | 1.01 | 17.4 | 61 |

TABLE 7

Variation of Stem Orifice Area

| Vapor Tap (mm) | Body Orifice (mm) | Stem Orifice ($mm^2$) | Dip tube (mm) | Exit Orifice (mm) | D ($\mu$m) | Q (g/s) | R (wt. %) | CV |
|---|---|---|---|---|---|---|---|---|
| 0.127 | 0.330 | 0.405 | 1.524 | 0.457 | <36 | <0.72 | >0.58 | <25 |
| 0.127 | 0.330 | 0.584 | 1.524 | 0.457 | <36 | <0.72 | >0.58 | <25 |
| 0.127 | 0.330 | 1.824 | 1.524 | 0.457 | 36 | 0.72 | 0.58 | 15 |

TABLE 8

Variation of Dip Tube Inner Diameter

| Vapor Tap (mm) | Body Orifice (mm) | Stem Orifice ($mm^2$) | Dip tube (mm) | Exit Orifice (mm) | D ($\mu$m) | Q (g/s) | R (wt. %) | CV |
|---|---|---|---|---|---|---|---|---|
| 0.127 | 0.330 | 1.824 | 1.016 | 0.457 | 34 | 0.71 | 6.9 | 27 |
| 0.127 | 0.330 | 1.824 | 1.270 | 0.457 | 34 | 0.72 | 5.8 | 24 |
| 0.127 | 0.330 | 1.824 | 1.524 | 0.457 | 36 | 0.72 | 0.58 | 15 |
| 0.127 | 0.330 | 1.824 | 2.286 | 0.457 | 35 | 0.76 | 4.2 | 22 |
| 0.127 | 0.330 | 1.824 | 3.099 | 0.457 | 35 | 0.86 | 11.6 | 40 |

From our complete tabular data, we were able to determine which combinations of valve orifice dimensions minimized the value of CV and provided the best performance at a propellant content of 14.5%. In particular, we found that a valve according to a third embodiment, having a body orifice diameter of about 0.013" (0.330 mm), a vapor tap diameter of about 0.005" (0.127 mm), an exit orifice diameter of about 0.018" (0.457 mm), a dip tube inner diameter of about 0.060" (1.524 mm), and at least one stem orifice having a total area of at least about 0.002827" (1.824 mm) provided the best performance for an aerosol air freshener. The third embodiment is substantially the same as the first embodiment in many respects, the main differences being the lower possible propellant content and the different ranges of orifice sizes. In this embodiment, A-60 propellant was again used as the propellant, and a swirl chamber mechanical breakup element was employed. Of course, no such mechanical breakup element is required.

The above tables were generated based on experimental data using dispenser assemblies having a propellant content of 14.5%. Gradual increases in propellant content, of course, significantly improve the quality of the dispensed sprays. Thus, by increasing the propellant content slightly, a broader range of valve orifice dimensions become acceptable. That is, a broader range of valve orifice dimensions will achieve an acceptable quality value. For example, simply increasing the propellant content of the preferred embodiment by 2%, the quality value was cut almost in half, from 15.3 to 8.8. We envision that many applications may benefit from using an aerosol dispenser assembly having a propellant content of less than 25%, but greater than the 14.5% achieved by our invention.

We believe it would be possible to produce an aerosol dispenser assembly that requires even less than 14.5% propellant to dispense its contents by employing some of the other factors that were thought to affect the performance characteristics. For example, by providing an even smaller vapor tap, by incorporating some form of mechanical breakup element, by experimenting with different propellant types, by employing different land lengths, and/or by using different materials for construction, we envision being able to achieve satisfactory performance with as little as about 10% propellant content.

Of course, different products, such as paint, deodorant, hair fixatives, and the like, will have different material properties and may, therefore, require different valve orifice sizes. In addition, different products may have different spray characteristics that are acceptable to consumers. Therefore, a different formula for quality may have to be developed for each different product, in order to determine the appropriate valve orifice sizes for that product. We believe, however, that some products, such as insecticides, will have similar physical properties to the aerosol air fresheners upon which our study was based. Accordingly, we would expect such insecticides to have the same or similar formula for quality.

The embodiments discussed above are representative of preferred embodiments of the present invention and are provided for illustrative purposes only. They are not intended to limit the scope of the invention. Although specific components, configurations, materials, etc., have been shown and described, such are not limiting. For example, various other combinations of valve components, propellant types, propellant pressures, and valve orifice dimensions, can be used without departing from the spirit and scope of our invention, as defined in the claims. In addition, the teachings of the various embodiments may be combined with one another, as appropriate, depending on the desired performance characteristics of the valve.

We claim:

1. An aerosol dispenser assembly comprising:

a container holding a liquid product and a liquefied gas propellant for propelling the liquid product from said container, the propellant being present in a quantity of at most about 25% by weight of the contents of said container; and a valve attached to said container for selectively dispensing the liquid product from said container as a mist, said assembly having a Clark/Valpey (CV) value of at most about 25, where $CV=2.5(D-32)+10|Q-1.1|+2.6R$, D being the average diameter in micrometers of particles dispensed during the first forty seconds of spray of said assembly, Q being the average spray rate in grams/second during the first forty seconds of spray of said assembly, and R being the amount of the product remaining in said container at the end of the life of said assembly expressed as a percentage of the initial fill weight.

2. An aerosol dispenser assembly according to claim 1, the propellant being present in a quantity of between about 10% and about 25% by weight of the contents of said container.

3. An aerosol dispenser assembly according to claim 1, wherein D is in the range of about 25 to about 40 micrometers.

4. An aerosol dispenser assembly according to claim 1, wherein D is in the range of about 30 to about 35 micrometers.

5. An aerosol dispenser assembly according to claim 1, wherein Q is in the range of about 0.7 to about 1.4 grams/second.

6. An aerosol dispenser assembly according to claim 1, wherein Q is in the range of about 1.0 to about 1.3 grams/second.

7. An aerosol dispenser assembly according to claim 1, wherein R is at most about 2.0% of the initial fill weight.

8. An aerosol dispenser assembly according to claim 1, wherein R is at most about 1.0% of the initial fill weight.

9. An aerosol dispenser assembly according to claim 1, wherein the propellant is present in a quantity of between about 10% and about 25% by weight of the contents of said container, and wherein D is in the range of about 30 to about 35 micrometers, Q is in the range of about 1.0 to about 1.3 grams/second, and R is at most about 1.0% of the initial fill weight.

10. An aerosol dispenser assembly according to claim 1, wherein the liquid product and the propellant form an oil-out emulsion when shaken.

11. An aerosol dispenser assembly according to claim 10, wherein the propellant is a hydrocarbon propellant.

12. An aerosol dispenser assembly according to claim 11, wherein the propellant is free of normal butane.

13. An aerosol dispenser assembly according to claim 1, wherein the contents of said container are pressurized to an initial can pressure of between about 55 psig and about 120 psig.

14. An aerosol dispenser assembly according to claim 1, wherein the contents of said container are pressurized to an initial can pressure of between about 55 psig and about 80 psig.

15. An aerosol dispenser assembly according to claim 1, wherein the contents of said container are pressurized to an initial can pressure of between about 70 psig and about 80 psig.

16. An aerosol dispenser assembly according to claim 1, said valve comprising a valve body and a valve stem, said valve body having a body orifice having a diameter of between about 0.254 and about 0.635 millimeters, for flow of the liquid product and propellant during dispensing.

17. An aerosol dispenser assembly according to claim 16, said valve body further having a vapor tap having a diameter of between about 0.076 and about 0.254 millimeters, for introducing additional propellant gas through said valve body in order to facilitate mixing of the propellant and the liquid product prior to dispensing.

18. An aerosol dispenser assembly according to claim 17, said valve stem defining at least one stem orifice having a total area of at least 0.405 square millimeters, for flow of the liquid product and propellant during dispensing.

19. An aerosol dispenser assembly according to claim 18, further comprising a dispenser cap coupled to said valve stem for actuating said valve to dispense the liquid product and propellant, said dispenser cap defining an exit orifice having a diameter of between about 0.330 and about 0.635 millimeters, through which the liquid product and the propellant are dispensed.

20. An aerosol dispenser assembly according to claim 19, further comprising a dip tube coupled to the underside of said valve body and extending toward the bottom of said container, said dip tube having an inner diameter of between about 1.016 and about 3.099 millimeters.

21. An aerosol dispenser assembly according to claim 20, the propellant being present in a quantity of at most about 15% by weight of the contents of said container.

22. An aerosol dispenser assembly according to claim 20, the propellant being present in a quantity of between about 10% and about 15% by weight of the contents of said container.

23. An aerosol dispenser assembly according to claim 1, said valve comprising a valve body and a valve stem, said valve body having a body orifice having a diameter of between about 1.270 and about 1.575 millimeters, for flow of the liquid product and propellant during dispensing.

24. An aerosol dispenser assembly according to claim 23, said valve body further having a vapor tap having a diameter of between about 0.254 and about 0.483 millimeters, for introducing additional propellant gas through said valve body in order to facilitate mixing of the propellant and the liquid product prior to dispensing.

25. An aerosol dispenser assembly according to claim 24, said valve stem defining at least one stem orifice having a total area of at least about 0.203 square millimeters, for flow of the liquid product and propellant during dispensing.

26. An aerosol dispenser assembly according to claim 25, further comprising a dispenser cap coupled to said valve stem for actuating said valve to dispense the liquid product and propellant, said dispenser cap defining an exit orifice having a diameter of between about 0.330 and about 0.635 millimeters, through which the liquid product and the propellant are dispensed.

27. An aerosol dispenser assembly according to claim 26, further comprising a dip tube coupled to the underside of said valve body and extending toward the bottom of said container, said dip tube having an inner diameter of between about 1.016 and about 1.524 millimeters.

28. An aerosol dispenser assembly comprising:

a container holding a liquid product and a liquefied gas propellant for propelling the liquid product from said container, the propellant being present in a quantity of at most about 25% by weight of the contents of said container;

a valve attached to said container for selectively dispensing the liquid product and the propellant from said container, said valve comprising:

(a) a valve body having (i) a body orifice having a diameter of between about 1.270 and about 1.575 millimeters, for flow of the liquid product and the propellant during dispensing, and (ii) a vapor tap having a diameter of between about 0.254 and about 0.483 millimeters, for introducing additional propellant gas through said valve body in order to facilitate mixing of the propellant and the liquid product prior to dispensing; and (b) a valve stem disposed in said valve and defining at least one stem orifice having a total area of at least about 0.203 square millimeters, for flow of the liquid product and the propellant during dispensing; and a dispenser cap coupled to said valve stem for actuating said valve to dispense the liquid product, said dispenser cap defining an exit orifice having a diameter of between about 0.330 and about 0.635 millimeters, through which the liquid product and the propellant are dispensed.

29. An aerosol dispenser assembly according to claim 28, said body orifice having a diameter of about 1.270 millimeters.

30. An aerosol dispenser assembly according to claim 28, said vapor tap having a diameter of between about 0.330 and about 0.457 millimeters.

31. An aerosol dispenser assembly according to claim 28, said vapor tap having a diameter of about 0.406 millimeters.

32. An aerosol dispenser assembly according to claim 28, said at least one stem orifice having a total area of at least about 0.405 square millimeters.

33. An aerosol dispenser assembly according to claim 28, said exit orifice having a diameter of between about 0.381 and about 0.559 millimeters.

34. An aerosol dispenser assembly according to claim 28, said exit orifice having a diameter of about 0.508 millimeters.

35. An aerosol dispenser assembly according to claim 28, further comprising a dip tube coupled to the underside of said valve body and extending toward the bottom of said container, said dip tube having an inner diameter of between about 1.016 and about 1.524 millimeters.

36. An aerosol dispenser assembly according to claim 35, said dip tube having a diameter of about 1.524 millimeters.

37. An aerosol dispenser assembly comprising:

a container holding a liquid product and a liquefied gas propellant for propelling the liquid product from said container, the propellant being present in a quantity of at most about 25% by weight of the contents of said container; and a valve attached to said container for selectively dispensing the liquid product and the propellant from said container, said valve comprising:

(a) a valve body having i) a body orifice having a diameter of between about 0.254 and about 0.635 millimeters, for flow of the liquid product and the propellant during dispensing, and ii) a vapor tap having a diameter of between about 0.076 and about 0.254 millimeters, for introducing additional propellant gas through said valve body in order to facilitate mixing of the propellant and the liquid product prior to dispensing; and (b) a valve stem disposed in said valve and defining at least one stem orifice having a total area of at least 0.405 square millimeters, for flow of the liquid product and the propellant during dispensing; and a dispenser cap coupled to said valve stem for actuating said valve to dispense the liquid product, said dispenser cap defining an exit orifice having a diameter of between about 0.330 and about 0.635 millimeters, through which the liquid product and the propellant are dispensed.

38. An aerosol dispenser assembly according to claim 37, said body orifice having a diameter of between about 0.330 and about 0.381 millimeters.

39. An aerosol dispenser assembly according to claim 37, said body orifice having a diameter of about 0.330 millimeters.

40. An aerosol dispenser assembly according to claim 37, said vapor tap having a diameter of between about 0.127 and about 0.203 millimeters.

41. An aerosol dispenser assembly according to claim 37, said vapor tap having a diameter of about 0.127 millimeters.

42. An aerosol dispenser assembly according to claim 37, said at least one stem orifice having a total area of at least about 0.584 square millimeters.

43. An aerosol dispenser assembly according to claim 37, said at least one stem orifice having a total area of at least about 1.824 square millimeters.

44. An aerosol dispenser assembly according to claim 37, said exit orifice having a diameter of between about 0.381 and about 0.559 millimeters.

45. An aerosol dispenser assembly according to claim 37, said exit orifice having a diameter of about 0.457 millimeters.

46. An aerosol dispenser assembly according to claim 37, further comprising a dip tube coupled to the underside of said valve body and extending toward the bottom of said container, said dip tube having an inner diameter of between about 1.016 and about 3.099 millimeters.

47. An aerosol dispenser assembly according to claim 46, said dip tube having a diameter of between about 1.270 and about 2.286 millimeters.

48. An aerosol dispenser assembly according to claim 46, said dip tube having a diameter of about 1.524 millimeters.

49. An aerosol dispenser assembly according to claim 37, the propellant being present in a quantity of at most about 15% by weight of the contents of said container.

50. An aerosol dispenser assembly according to claim 37, the propellant being present in a quantity of between about 10% and about 25% by weight of the contents of said container.

51. An aerosol dispenser assembly according to claim 50, said body orifice having a diameter of between about 0.330 and about 0.381 millimeters, said vapor tap having a diameter of between about 0.127 and about 0.203 millimeters, said at least one stem orifice having a total area of at least about 0.584 square millimeters, and said exit orifice having a diameter of between about 0.381 and about 0.559 millimeters.

52. An aerosol dispenser assembly according to claim 51, the propellant being present in a quantity of between about 10% and about 15% by weight of the contents of said container.

53. An aerosol dispenser assembly comprising:

a container holding a liquid product and a liquefied gas propellant for propelling the liquid product from said container, the propellant being present in a quantity of at most about 15% by weight of the contents of said container; and a valve attached to said container, said valve being capable of selectively dispensing the liquid product and the propellant from said container as a mist having a particle size in the range of about 15 micrometers to about 60 micrometers at a rate of between about 0.6 and about 1.8 grams/second, at least during the first 10 seconds of spraying time of the life of said assembly.

54. An aerosol dispenser assembly comprising:

a container that contains a liquid product and a propellant for propelling the liquid product from said container, wherein the propellant is a liquefied gas propellant and is present in an amount of at most about 25% by weight of the contents of said container; and a valve attached to said container for selectively dispensing the liquid product from said container as a mist, wherein the dispensed mist has an average particle size of less than about 35 micrometers, over at least about 75% of the life of said dispenser assembly.

55. An aerosol dispenser assembly according to claim 54, wherein the propellant is a hydrocarbon propellant.

56. An aerosol dispenser assembly according to claim 55, wherein the propellant is free of normal butane.

57. An aerosol dispenser assembly according to claim 54, wherein the contents of said container are pressurized to between about 55 psig and about 120 psig.

58. An aerosol dispenser assembly according to claim 54, wherein the contents of said container are pressurized to between about 55 psig and about 80 psig.

59. An aerosol dispenser assembly according to claim 54, wherein the contents of said container are pressurized to between about 70 psig and about 80 psig.

60. An aerosol dispenser assembly according to claim 54, further comprising a vapor tap formed in said valve to facilitate thorough mixing of the propellant and the liquid product prior to dispensing, and a valve stem disposed in said valve and defining at least one stem orifice for flow of the product during dispensing.

61. An aerosol dispenser assembly according to claim 60, wherein said vapor tap has a diameter of about 0.330 to about 0.483 millimeters.

62. An aerosol dispenser assembly according to claim 60, wherein said valve stem defines a pair of stem orifices.

63. An aerosol dispenser assembly according to claim 60, further comprising:

a dispenser cap mounted on said valve stem for actuating said valve to dispense the liquid product, said dispenser cap defining an exit path for the liquid product to be dispensed; and a breakup bar positioned in the exit path of said dispenser cap to break up the liquid product in order to reduce the size of the particles before the liquid product is dispensed.

64. An aerosol dispenser assembly comprising:

a container for containing a liquid product and a propellant for propelling the liquid product from said container, wherein the propellant is a liquefied gas propellant and is present in an amount of at most about 25% by weight of the contents of said container; and a valve attached to said container for selectively dispensing the liquid product from said container, wherein said dispenser assembly is capable of dispensing over about 98% by weight of the liquid product from said container.

65. An aerosol dispenser assembly according to claim 64, wherein the propellant is a hydrocarbon propellant.

66. An aerosol dispenser assembly according to claim 65, wherein the propellant is free from normal butane.

67. An aerosol dispenser assembly according to claim 64, wherein the contents of said container are pressurized to between about 55 psig and about 120 psig.

68. An aerosol dispenser assembly according to claim 64, wherein the contents of said container are pressurized to between about 55 psig and about 80 psig.

69. An aerosol dispenser assembly according to claim 64, wherein the contents of said container are pressurized to between about 70 psig and about 80 psig.

70. An aerosol dispenser assembly according to claim 64, further comprising a vapor tap formed in said valve to facilitate thorough mixing of the propellant and the liquid product prior to dispensing, and a valve stem disposed in said valve and defining at least one stem orifice for flow of the product during dispensing.

71. An aerosol dispenser assembly according to claim 70, wherein said vapor tap has a diameter of about 0.330 to about 0.483 millimeters.

72. An aerosol dispenser assembly according to claim 70, wherein said valve stem defines a pair of stem orifices.

73. An aerosol dispenser assembly according to claim 70, further comprising:

a dispenser cap mounted on said valve stem for actuating said valve to dispense the liquid product, said dispenser cap defining an exit path for the liquid product to be dispensed; and a breakup bar positioned in the exit path of said dispenser cap to break up the liquid product in order to reduce the size of the particles before the liquid product is dispensed.

74. An aerosol dispenser assembly comprising:

a container that contains a liquid product and a propellant for propelling the liquid product from said container, wherein the propellant is a liquefied gas propellant and is present in an amount of at most about 25% by weight of the contents of said container; and a valve attached to said container for selectively dispensing the liquid product from said container as a mist, wherein the mist is dispensed at a rate of between about 0.6 to about 1.8 grams/second, over at least about 75% of the life of said dispenser assembly.

75. An aerosol dispenser assembly according to claim 74, wherein the mist is dispensed at a rate of between about 0.7 to about 1.4 grams/second, over at least about 75% of the life of said dispenser assembly.

76. An aerosol dispenser assembly according to claim 74, wherein the mist is dispensed at a rate of between about 0.9 to about 1.3 grams/second, over at least about 75% of the life of said dispenser assembly.

77. An aerosol dispenser assembly according to claim 74, further comprising a vapor tap formed in said valve to facilitate thorough mixing of the propellant and the liquid product prior to dispensing, and a valve stem disposed in said valve and defining at least one stem orifice for flow of the product during dispensing.

78. An aerosol dispenser assembly according to claim 74, further comprising a vapor tap formed in said valve to facilitate thorough mixing of the propellant and the liquid product prior to dispensing, and a valve stem disposed in said valve and defining at least one stem orifice for flow of the product during dispensing.

79. An aerosol dispenser assembly according to claim 74, wherein said vapor tap has a diameter of about 0.330 to about 0.483 millimeters.

80. An aerosol dispenser assembly comprising:

a container that contains a liquid product and a propellant for propelling the liquid product from said container, wherein the propellant is a liquefied gas hydrocarbon propellant, is free of normal butane, and is present in an amount of at most about 25% by weight of the contents of said container, and wherein the contents of said container are pressurized to between about 55 psig and about 80 psig;

a valve attached to said container for selectively dispensing the liquid product from said container as a mist, wherein the dispensed mist has an average particle size of less than about 35 micrometers, over at least about 75% of the life of said dispenser assembly, and wherein said dispenser assembly is capable of dispensing over about 98% by weight of the liquid product from said container;

a vapor tap formed in said valve to facilitate thorough mixing of the propellant and the liquid product prior to dispensing, said vapor tap having a diameter of about 0.330 to about 0.483 millimeters;

a valve stem disposed in said valve and defining at least one stem orifice for flow of the product during dispensing;

a dispenser cap mounted on said valve stem for actuating said valve to dispense the liquid product, said dispenser cap defining an exit path for the liquid product to be dispensed; and a breakup bar positioned in the exit path of said dispenser cap to break up the liquid product in order to reduce the size of the particles before the liquid product is dispensed.

* * * * *